United States Patent [19]

Steimel

[11] 4,368,748

[45] Jan. 18, 1983

[54] DEVICE FOR DEGREASING, TUMBLING AND WASHING OF INDUSTRIALLY MANUFACTURED OBJECTS

[76] Inventor: Richard Steimel, Frankfurt Strasse 134, 5202 Hennef/Sieg, Fed. Rep. of Germany

[21] Appl. No.: 315,207

[22] Filed: Oct. 26, 1981

Related U.S. Application Data

[62] Division of Ser. No. 114,091, Jun. 29, 1979, Pat. No. 4,314,856.

[30] Foreign Application Priority Data

Oct. 29, 1977 [DE] Fed. Rep. of Germany ..... 2748615

[51] Int. Cl.[3] ..... B08B 3/08

[52] U.S. Cl. ..... 134/96; 134/119; 134/141; 134/155; 134/161

[58] Field of Search ..... 134/25.4, 96, 119–121, 134/141, 155, 157–159, 161

[56] References Cited

U.S. PATENT DOCUMENTS

| | | | |
|---|---|---|---|
| 756,856 | 4/1904 | Hoffken | 134/119 X |
| 1,516,985 | 11/1924 | Pillar | 134/96 X |
| 1,911,312 | 5/1933 | Good | 134/119 X |
| 3,853,622 | 12/1974 | Rutten | 134/25.4 |
| 4,078,943 | 3/1978 | Saurenman | 134/25.4 X |
| 4,165,994 | 8/1979 | Jackson | 134/141 X |
| 4,314,856 | 2/1982 | Steimel | 134/25.4 |

FOREIGN PATENT DOCUMENTS

| | | | |
|---|---|---|---|
| 533361 | 9/1931 | Fed. Rep. of Germany | 134/96 |

*Primary Examiner*—Robert L. Bleutge
*Attorney, Agent, or Firm*—Michael J. Striker

[57] ABSTRACT

Centrifuge for degreasing and washing objects, particularly industrially manufactured pieces having blind holes, comprises a housing provided with a tilting device for tilting the centrifuge into an inclined position and returning it into an upright position. A rotary centrifuge drum is located within the housing and is equipped with a drive ring connected to an additional drive arrangement having a friction wheel adapted to be pressed against the drive ring to reduce the rotational speed of the centrifuge drum.

17 Claims, 4 Drawing Figures

DEVICE FOR DEGREASING, TUMBLING AND WASHING OF INDUSTRIALLY MANUFACTURED OBJECTS

This is a division, of application Ser. No. 114,091, filed June 29, 1979, now U.S. Pat. No. 4,314,856.

BACKGROUND OF THE INVENTION

The invention concerns a process and a device for the degreasing, tumbling, washing and drying of industrially manufactured pieces, in particular of objects with blind bores.

For the cleaning of objects of the type as noted herein, a process is known in which the objects are first degreased in a centrifuge, removed from the centrifuge after this step, and inserted into a separate scouring and washing device, in order to be dried thereafter, again in a centrifuge.

It is of disadvantage with this known cleaning process, that it is costly and time-consuming because the objects to be cleaned must be brought into a sepcial device for scouring and washing. This device for scouring and washing requires space, its procurement is tied to costs and the need of additional transportation to transport the objects between the centrifuge and the scouring and washing device.

SUMMARY OF THE INVENTION

It is the task of the invention to create a process which, by avoiding the disadvantages of the known process, will allow fast, problem-free cleaning of industrially manufactured objects with far-reaching automation, and where the design of the relevant device can be compact, favorable in its cost, and avoiding transportation.

This tank is solved by having a centrifuge drum filled with the objects to be treated, driven at high speed around a vertical axis of rotation, wherein the objects are being degreased and the removed oil is discharged; the centrifuge drum is subsequently braked down, tilted into a scouring-washing position and revolved, at reduced speed, around a second, inclined, axis of rotation, wherein the objects within the centrifugal drum are treated as in a scouring tumbler, a cleaning and/or rinsing agent, especially a cleaning lye is filled in, and, after this washing step, the centrifuge drum, remaining in the inclined axis of rotation, is imparted a higher speed wherein the cleaning and rinsing agent is discharged at least in part, the objects to be treated adjusting their location within the centrifuge drum in order to avoid larger imbalances and finally, the centrifuge drum, tilted back into the vertical centrifuging position imparted a higher speed in order to discharge the remaining cleaning and rinsing agent and also in order to dry the objects to be treated.

It is of advantage to blow hot air into the centrifuge drum during the drying phase, thus accelerating and improving drying.

Centrifuges with drive shafts for the centrifuge drum which can be tilted from a vertical position into an inclined position are known from the German Letters Patent DT-PS Nos. 194 809; 1 167 751 and 1 232 076. With these centrifuges, the tilting of the drive shaft serves to empty the drum or—in the German Letters Patent DT-PS No. 194 809—to distribute the centrifuging pieces within the centrifuge drum.

The process as per invention has the advantage that all operating steps required for degreasing, tumbling, washing, and drying can be carried out within just one device. Transportation of the objects to be cleaned, during the individual process steps, is thus eliminated. A combined centrifuge working as per this process is more favorable in costs than two separate devices, and also more space-saving than those. Furthermore, the combined centrifuge allows for simple automation of its controls and, in conclusion, the time requirement for the entire cleaning sequence is shorter as with the known process. When in the scouring-washing position, in which the centrifuge drum is moving at such a low speed that the objects can move relative to the centrifuge drum, the device as per invention assumes the function of the scouring-washing device of the known process. In order to allow removal and discharge of the cleaning and rinsing agent also in the tilted position of the centrifuge, the catch housing surrounding the centrifuge drum has a drain provided at its lowest point when in the tilted position, the drain being connected via a two-way valve with another reservoir for the removed liquid, especially oil, or with a reservoir for the cleaning agent and/or the rinsing agent respectively.

It is suitable for this purpose to have the jacket of the centrifuge drum in cylindrical shape and with discharge openings for the removed liquid, being surrounded by a sheet metal jacket tapering in such a manner that it is widening at the top, and the upper rim of which is extended at least up to the upper rim of the drum jacket. In the inclined position of the centrifuge, the centrifuge drum and the sheet metal jacket can be filled with cleaning and/or rinsing liquid to the lowest point of the upper rim of the sheet metal jacket.

It is furthermore proposed that the lower structure be attached to a tilting frame which is tiltable on a base frame, and that a tilting drive of adjustable length be arranged between base frame and centrifuge. In this way, the tilting of the centrifuge between its vertical centrifuging position and its inclined position can be achieved in a simple manner. It is suitable to design the tilting drive as a cylinder-piston unit which can be locked hydraulically, and which, being subjected to a high pressure, for instance 50 bar to 100 bar, by means of a pressure accumulator, will retain the centrifuge in the normal position or in the tilted position.

The supply of the cleaning and rinsing agent into the centrifuge drum is suitably made through a feeder on the centrifuge cover. These agents can, however, also be fed into the centrifuge through the drive shaft of the centrifuge drum.

By the new process, and with the aid of the device as per invention, industrial products of various types, for instance lathe-turned parts with blind bores, electrical terminals and plugs, hollow bodies etc., can be degreased, tumbled, washed and dried. The operating sequence is as follows: A cart with a lifting device picks up a filled basket from the charging station and inserts it into the combined centrifuge as per invention. After closing of the cover, the centrifuge will run at maximum speed and with a vertical axis of rotation in order to effect degreasing. Herein, the tilting device is locked automatically and the removed oil flows through the discharge and into a drain.

After a sufficient centrifuging period, the centrifuge is braked down and tilted into the securing-washing position. In this position, the centrifuge is driven so slow that the objects contained in it will be treated as in a scouring drum. An alkaline liquid with a temperature of 80° C., containing, in given instances a rust-preventing agent as additive, is fed into the drum through a supply line in the centrifuge cover. Upon conclusion of the washing sequence, the used washing lye is pumped back, via a two-way valve, into a reservoir.

Following this scouring-washing sequence, the drum which is still in tilted position, will be imparted a somewhat higher speed, so that the objects to be treated can redistribute themselves within the centrifuge drum. Herein, a large proportion of the cleaning and washing liquid used, will flow back, via a two-way valve, into a storage or supply reservoir. Only thereafter is the centrifuge drum tilted back into the centrifuging position, locked hydraulically, imparted the maximum speed—f.i. 1000 revolutions per minute—and the remaining liquid is removed. During this final operating sequence, drying is assisted by a flow of hot air. After the centrifuge has been braked down, the cover will open automatically, the basket can be grabbed, removed and brought to the discharging station.

A design version of the device as per invention is shown in the drawing and described more closely hereunder.

BRIEF DESCRIPTION OF THE PREFERRED EMBODIMENTS

DETAILED DESCRIPTION OF THE PREFERRED EMBODIMENTS

Figure 1:
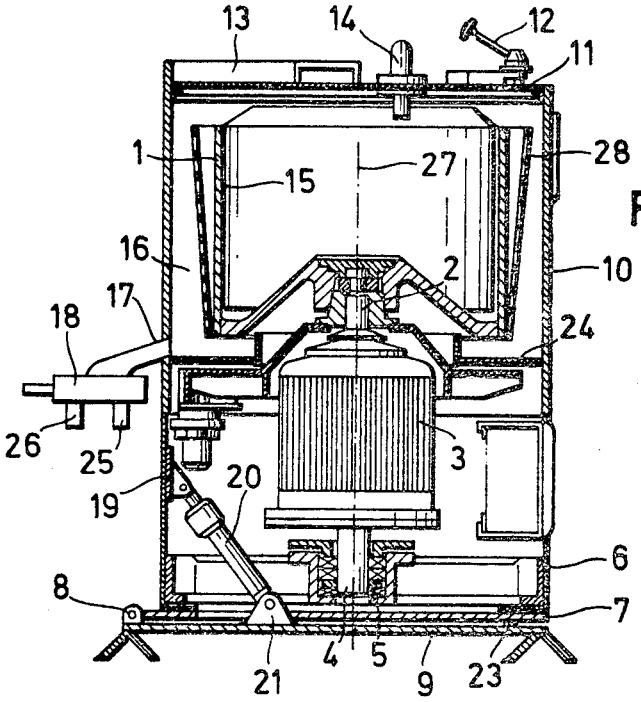
FIG. 1 is a section along a cutting line running through the drive shaft, through a centrifuge in the vertical centrifuging position.
Figure 2:
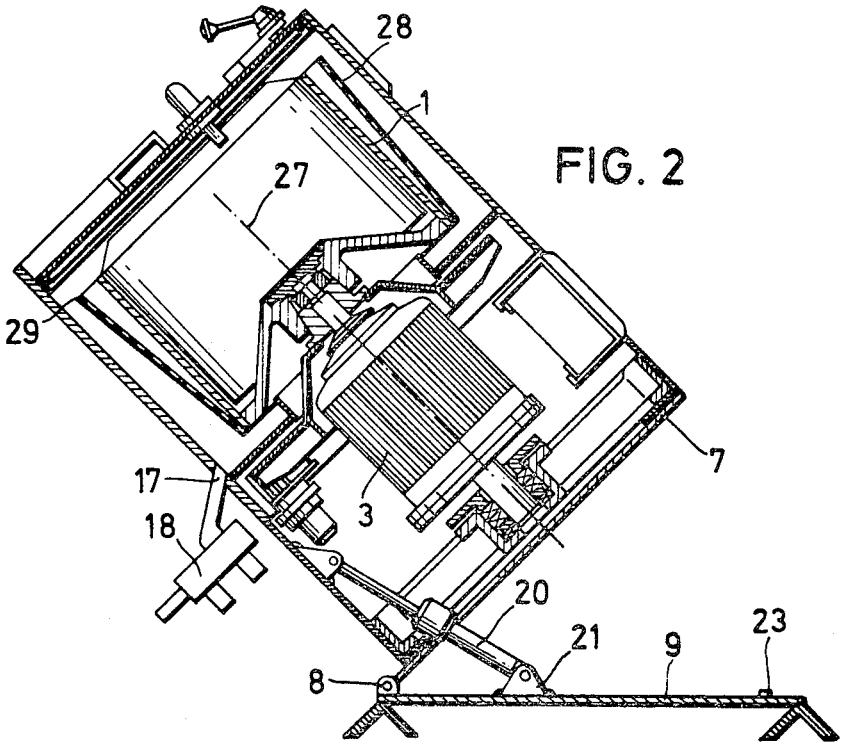
FIG. 2 is a representation as per FIG. 1, of a centrifuge in the scouring-washing position, with the rotating axis of the centrifuge tilted against the vertical.

The centrifuge shown in FIG. 1 and 2 shows a centrifue drum 1 which is mounted on the drive shaft 2 of an electric motor 3. The motor 3 is retained in the lower structure 6 of the centrifuge, via a trunnion 4 and an elastic bearing 5. The lower structure 6 is mounted on a tilting frame 7 which is linked to the base frame 9 that is anchored to the foundation, in such a manner that it can swivel around the axle 8.

A centrifuge housing 10, surrounding the motor 3 and the centrifuge drum 1, which can be closed by the housing cover 11, is mounted respectively on the lower structure 6 and the tilting frame 7. The housing frame 11 is provided with a closure 12 which allows starting the drive motor 3 only when in locked position.

A hot-air channel 13 is also attached on the cover, so that hot air can be supplied to the centrifuge drum 1. A feed 14 is furthermore provided on the cover, through which cleaning and rinsing agents can be supplied to the centrifuge drum 1.

A basket 15 can be inserted into the centrifuge drum 1 for the inserting and withdrawing of the products to be treated into and from the drum 1. The catch housing 16 surrounding the centrifuge drum 1 shows at its lowest zone a discharge 17 which can be shut off by means of a two-way valve 18.

A cylinder-piston unit 20, which can move the centrifuge into the tilt position shown in FIG. 2, is arranged between the base frame 9 and the centrifuge. By means of a pressure accumulator not shown, locking can be effected at high applied pressure.

In the version shown, the cylinder-piston unit 20, is linked on one hand with the cylinder-mount pivot 21 which is in fixed attachment on the base plate 9, and on the other linked to a piston pivot 22 which is in fixed attachment on the centrifuge housing 10 and through reinforcing ribs 19 respectively, with the lower structure 6. The tilting side of the centrifuge is supported by a pad 23 connected to the base frame 9.

In order to bring the centrifuge drum 1 from the position shown in FIG. 1, in which it is revolving around the vertical rotating axis 27, into the tilted position shown in FIG. 2, the entire centrifuge is is brought into a inclined position by means of the cylinder-piston unit 20. In this scouring-washing position the centrifuge drum 1 is revolving on an axis of rotation 27 which is forming an angle of about 45° with the perpendicular. This angle is so dimensioned that on one hand the centrifuge drum 1 can contain sufficient washing liquid, and that on the other, there will be ample possibility for the objects to be treated in the centrifuge drum 1 to re-arrange themselve under the influence of gravity and centrifugal force. With an increasing tilt angle, the holding capacity of the centrifuge drum 1 will decrease, the re-arranging will however improve. The tilt of 45° shown in FIG. 1 represents a favorable compromise for the shape of the centrifuge drum 1 as selected.

In the vertical centrifuging position as shown in FIG. 1, the centrifuge drum 1 should be able to run at a high speed for example, 1,000 revolutions per minute. It thus becomes necessary that during the centrifuging phase, the centrifuge housing 10 is in fixed attachment with the base frame 9, via the tilting frame 7. It will suits the purpose, to have hydraulic locking for the cylinder-piston unit 20. Herein the centrifuge is pressed by the cylinder-piston unit 20 at high pressure originating from the pressure accumulator, against the stops determining the tilted and normal position. Near the pad 23, a locking device with, for instance, electro magnetic activation and mechanical action, can also be arranged. It is, however, appropriate to select a cylinder-piston unit 20 with a double-acting hydraulic piston, so that hydraulic locking under high pressure can also be effected in the tilted position.

The closure component 18 has a minimum of two control positions. In one control position, the removed liquid, particularly oil, is led via the drain 25 into a reservoir, in the second control position the discharge 17 is connected via the drain 26 with a reservoir for the cleaning and rinsing agent.

In the tilted position shown in FIG. 2, the centrifuge drum 1 can be filled with cleaning liquid up to the level of the lowest point of the upper rim 29 of the tapering jacket 28. The tapering jacket 28 can be omitted if the centrifuge drum 1 is tapered in such a way that the liquid which has been centrifuged out, is thrown from the upper rim of the centrifuged drum 1 into the reservoir 16. If, however, the drum jacket is cylindrical and the passage openings of the drum jacket are arranged in the lower zone of the drum a conical jacket 28 is necessary. This jacket 28 will remove the centrifuged liquid via its upper rim 29.

Figure 3:
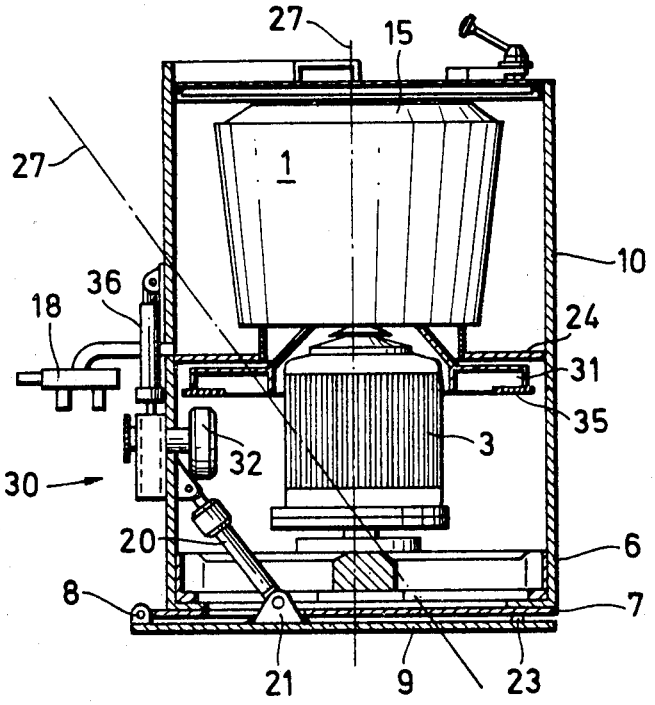
FIG. 3 is a section as per FIG. 1 through a modified version of the centrifuge as per invention.
Figure 4:
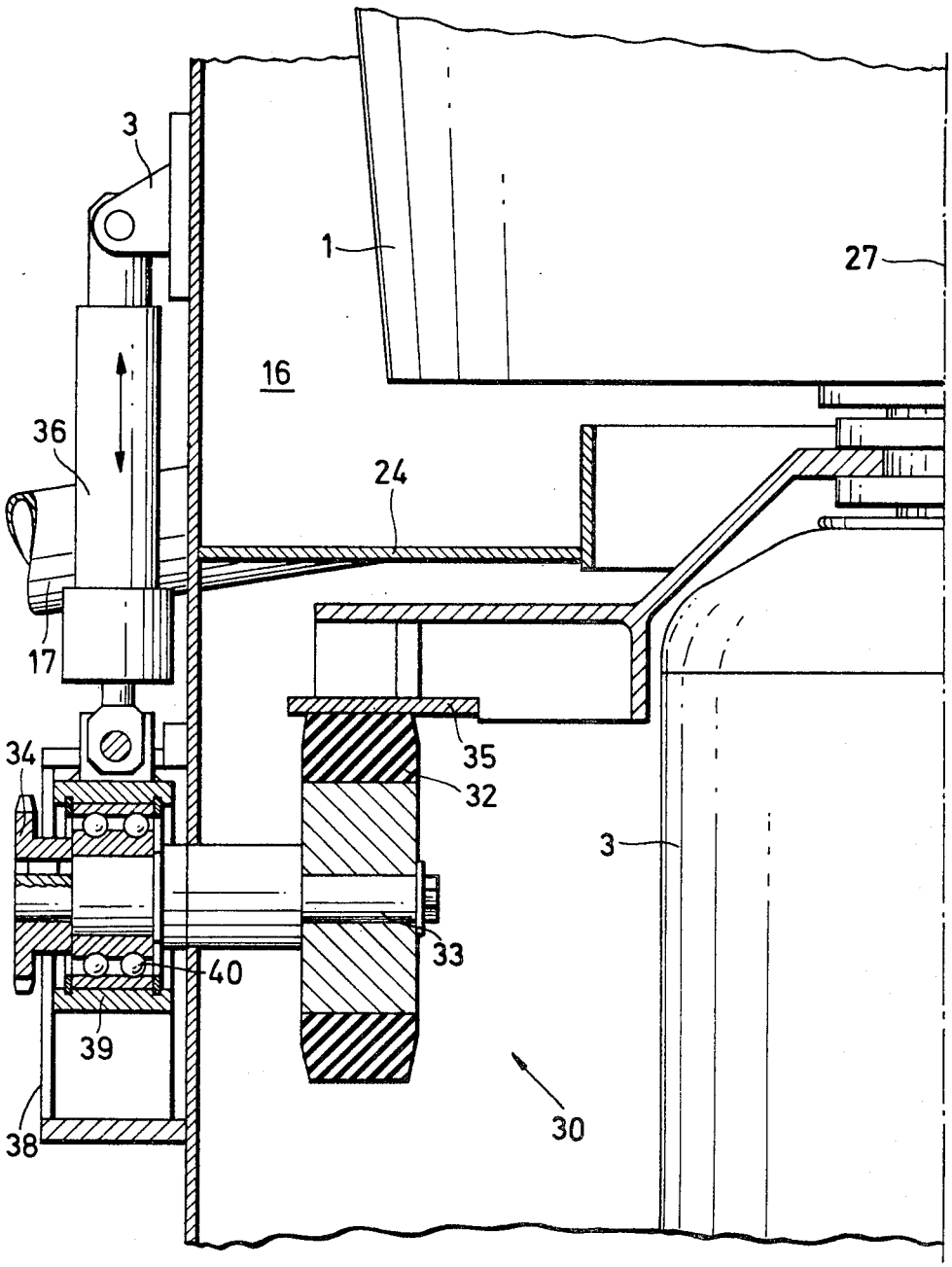
FIG. 4 is an enlarged cutout from FIG. 3.

FIGS. 3 and 4 show a modified version of the centrifuge as per invention, where apart from the drive motor 3, an additional drive motor is provided which, in the tilted position of the centrifuge, will drive, via a friction drive 30, the centrifuge drum 1 at low speed. The centrifuge drum 1 is rigidly connected to the ventilator wheel 31 to which an essential horizontal drive ring is attached. Against this drive ring 35, a friction wheel 32 can be pressed, its axis 33 being driven from a pinion 34 and being supported in the guide block 39 by an anti-friction bearing 40. Within the guide housing 38, which is mounted on the centrifuge housing 10, the guide block 39 can be moved at a right angle to the plane of the drive ring 35. A hydraulically actuated cylinder-piston unit 36 with its upper end linked to a pivot bearing 37 attached to the centrifuge housing 10 moves the guide block 39.

Since for the lower speed a considerably reduced motor output is required, it is of advantage to provide an additional drive motor. Since at lower speeds, the imbalances of the drum filled with the products to be treated will also be small, the drive power can be transmitted without further measures via the friction wheel 32 to the drive ring 35 which is rigidly attached to the drum 1. The negligible vertical movements of the friction wheel 32 which are generated during drive, can be attenuated in a elastic manner by the cylinder-piston unit 36 without any further measures, so that the friction wheel 32 will continually with the same force, the drive wheel 35. If the additional drive is switched off, the cylinder-piston unit 36 will lower the guide block 39, and thus also the friction wheel 32, so far that the drive ring 35 can perform unimpeded its wobbling movement which is caused by the imbalances in the drum.

The process, as per invention, can also be used for a centrifuge with bottom discharge in which the drum jacket can be lifted from the drum bottom. For the implementation of the process as per invention by means of such a centrifuge, the drum jacket is so designed that the passage openings will be located as high as possible and the drum will contain as much as possible of the liquid also when in the tilted position.

It will be understood that each of the elements described above, or two or more together, may also find a useful application in other types of centrifuge arrangements differing from the types described above.

While the invention has been illustrated and described as embodied in a centrifuge for degreasing and washing objects, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifuge for degreasing, tumbling and washing of industrially manufactured objects, comprising a rotary centrifuge drum having a vertical axis of rotation; means for feeding cleaning and rinsing agents into said drum; a catch housing surrounding said drum and having a bottom; means for tilting the centrifuge and returning it to a vertical position; and means for discharging the remaining cleaning and rinsing agents from said drum, said discharging means being located at said bottom of said catch housing in such a manner that the discharge will be at the lowest point when said centrifuge drum is tilted, said discharging means including a two-way valve connectable to a reservoir for a removed liquid an/or with a reservoir for the cleaning and rinsing agent.

2. The centrifuge of claim 1, comprising a stationary base frame anchored to the floor and a lower structure connected to said catch housing and positioned beneath thereof.

3. The centrifuge of claim 2, wherein said tilting means include a tilting frame to which said lower structure is attached, and a tilting drive on said base frame, said tilting being hingedly connected to said base frame, said tilting drive being arranged between said base frame and said lower structure with an adjustable length.

4. The centrifuge of claim 3, wherein said tilting drive includes at least one hydraulically actuated cylinder-piston unit.

5. The centrifuge of claim 4, wherein said cylinder-piston unit may be locked hydraulically under relatively high pressure by means of a hydraulic accumulator.

6. The centrifuge of claim 5, wherein said high pressure is about 80 bar.

7. The centrifuge of claim 4, including a cover, said feeding means being arranged in said cover.

8. The centrifuge of claim 7, said drum having an opening, said feeding means being located above said opening.

9. The centrifuge of claim 8, said drum having a casing of a substantially cylindrical shape and having discharge openings for the removed liquid.

10. The centrifuge of claim 9, wherein said drum is provided with a sheet metal jacket surrounding said casing and having an upper rim, said jacket tapering out towards said cover and extending with said upper rim at least to the hight of said casing.

11. The centrifuge of claim 10, wherein the control of said two-way valve depends upon the inclination of the centrifuge.

12. The centrifuge of claim 11, further including a drive motor of a reversible-pole type connected to said drum.

13. The centrifuge of claim 12, further including additional drive means for driving said drum at reduced speed, said additional drive means including an adjusting device mounted on the centrifuge and including a friction drive adapted to be pressed on against said drum for driving the latter.

14. The centrifuge of claim 13, wherein said friction drive includes a guide block, a friction wheel supported in said guide block, and a cylinder-piston unit operatively connected to said guide block.

15. The centrifuge of claim 14, wherein said additional drive means include a drive ring on said drum, said friction wheel being pressed against said drive ring.

16. The centrifuge of claim 15, wherein said friction drive includes a guide housing, said guide block being supported in said guide housing, said guide housing being attached to said lower structure and being adapted to move at a right angle relative to said drive ring.

17. The centrifuge of claim 16, including a ventilator wheel connected to said drum at a bottom thereof, said drive ring being arranged on said ventilator wheel, said ventilator wheel partially surrounding said drive motor.

* * * * *